US008281415B2

(12) United States Patent
Voravan

(10) Patent No.: US 8,281,415 B2
(45) **Date of Patent: *Oct. 9, 2012**

(54) SPORT GLOVE CLOSURE SYSTEM

(75) Inventor: M. L. Poramats Voravan, Lumpini Patumwan (TH)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/279,506

(22) Filed: Oct. 24, 2011

(65) Prior Publication Data

US 2012/0036611 A1 Feb. 16, 2012

Related U.S. Application Data

(63) Continuation of application No. 12/697,338, filed on Feb. 1, 2010, now Pat. No. 8,060,947.

(51) Int. Cl.
*A41D 19/00* (2006.01)

(52) U.S. Cl. ..... 2/161.2; 24/593.11; 24/596.1; 24/904

(58) Field of Classification Search ..... 2/160, 161.1, 2/161.2, 162, 170; 24/593.11, 596.1, 904, 24/68 R, DIG. 43, 47, 48
See application file for complete search history.

(56) References Cited

U.S. PATENT DOCUMENTS

| | | | | |
|---|---|---|---|---|
| 1,083,795 | A | 6/1914 | Brokaw | |
| 2,035,031 | A | 3/1936 | Von Kocizian | |
| 3,147,526 | A | 9/1964 | Winson | |
| 4,040,126 | A | 8/1977 | Cecil | |
| 4,042,977 | A | 8/1977 | Antonious | |
| 4,658,445 | A | 4/1987 | Tibble | |
| 4,701,963 | A | 10/1987 | Overton | |
| 5,195,188 | A | 3/1993 | Bourdeau et al. | |
| 5,263,202 | A | 11/1993 | Siberell | |
| 5,647,104 | A | 7/1997 | James | |
| 5,704,065 | A | 1/1998 | Feuerbake | |
| 5,740,555 | A | 4/1998 | Renegar | |
| 6,052,828 | A | 4/2000 | Widdemer | |
| 6,286,148 | B1 | 9/2001 | Meyer | |
| 7,480,944 | B2 | 1/2009 | Nascimento | |
| 7,799,006 | B2 | 9/2010 | Kline et al. | |
| 8,060,946 | B2 * | 11/2011 | Voravan et al. | 2/161.1 |
| 8,060,947 | B2 * | 11/2011 | Voravan | 2/161.2 |
| 2010/0175163 | A1 | 7/2010 | Litke | |

* cited by examiner

*Primary Examiner* — Katherine Moran
(74) *Attorney, Agent, or Firm* — D. Michael Burns

(57) ABSTRACT

A glove closure system having an opening dividing the glove into a lateral portion (thumb side) and a medial portion (pinky side). The opening allows for easy access of the user's hand. The system consists of a rectangular or oval flap attached to the lateral portion and pulled over the access opening. A push button is mounted on the flap and movably connected to a slide bar attached to the medial portion. The slide bar includes a notched surface for engaging and stationing the button at any point along the bar. The button includes a release tab which when depressed allows the button to move along the slide bar therein allowing for the closure to either be tightened or loosened. The further the button moves toward the lateral portion the tighter the closure. When the button is engaged and locked, a simple press on the release tab disengages to allow the glove to be opened.

7 Claims, 2 Drawing Sheets

SPORT GLOVE CLOSURE SYSTEM

CROSS-REFERENCE TO RELATED APPLICATIONS

The present invention is a continuation of U.S. application Ser. No. 12/697,338, now U.S. Pat. No. 8,060,947, filed on Feb. 1, 2010, the disclosure of which is incorporated herein in its entirety.

FIELD OF THE INVENTION

The present invention relates generally to sport gloves, and more specifically, to golf gloves with a sliding push button closure system.

BACKGROUND OF THE INVENTION

With respect to athletic gloves, such as those used in golf, it is important that a glove fit properly and be firmly secured about the wearer's hand to ensure that the glove does not interfere with the feel of a sports instrument in the wearer's hand. While adequate sizing plays a role in ensuring proper fit, a glove must also initially be loose enough to allow the wearer's hand ingress and egress. Thus, to ensure proper fit, there must be a way to tighten the glove after it has been placed over the wearer's hand.

There currently exist a number of mechanisms and methods for tightening gloves around a wearer's hand. Such mechanisms include buckles, straps, buttons, ties, elastic, pull closures, hook and loop systems, cable systems and others. While these mechanisms allow gloves to be tightened, they generally have limited range, are difficult to adjust and operate one-handed, and/or have durability constraints. Buckles or straps, such as those disclosed in U.S. Pat. No. 4,042,977 for example, can be difficult to operate one-handed, as is often required when tightening a glove on to the wearer's other hand. Buttons, such as that in U.S. Pat. No. 1,083,795, are not only difficult to operate one-handed, but also are limited in the range of tightening that they can accomplish. Elastic portions, such as those discussed in U.S. Pat. No. 7,480,944, allow gloves to stretch to allow ingress and egress and then contract to hold the glove in place, and are easy to operate one-handed. However, they can stretch over time, such that they do not maintain a tight fit, and are limited in their ability to create tension around the wearer's hand for a truly snug fit. Pull closures, such as that disclosed in U.S. Pat. No. 5,263,202, allow an elastic strap to be pulled tight, but generally leave excess elastic cord hanging free, which is undesirable in an athletic glove. Lastly, hook and loop closures, often marketed as Velcro®, such as that disclosed in U.S. Pat. No. 4,701,963, can become clogged with other fibers or dirt, and can be difficult to pull tight with a single hand. Cable systems, such as that disclosed in U.S. Pat. No. 5,647,104, can be difficult to operate one-handed in the same manner as hook and loop closures.

Accordingly, there is a need for an improved glove fastening and tightening system.

SUMMARY OF THE INVENTION

The present invention is directed to a glove closure system having an opening dividing the glove into a lateral portion (thumb side) and a medial portion (pinky side). The opening allows for easy access of the user's hand. The system consists of a rectangular or oval flap attached to the medial portion and pulled over the access opening. A push button is mounted on the flap and movably connected to a slide bar attached to the medial portion. The slide bar includes a notched surface for engaging and stationing the button at any point along the bar. The button includes a release tab which when depressed allows the button to move along the slide bar therein allowing for the closure to either be tightened or loosened. The further the button moves toward the lateral portion the tighter the closure. When the button is engaged and locked, a simple press on the release tab disengages to allow the glove to be opened.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE INVENTION

Figure 1:
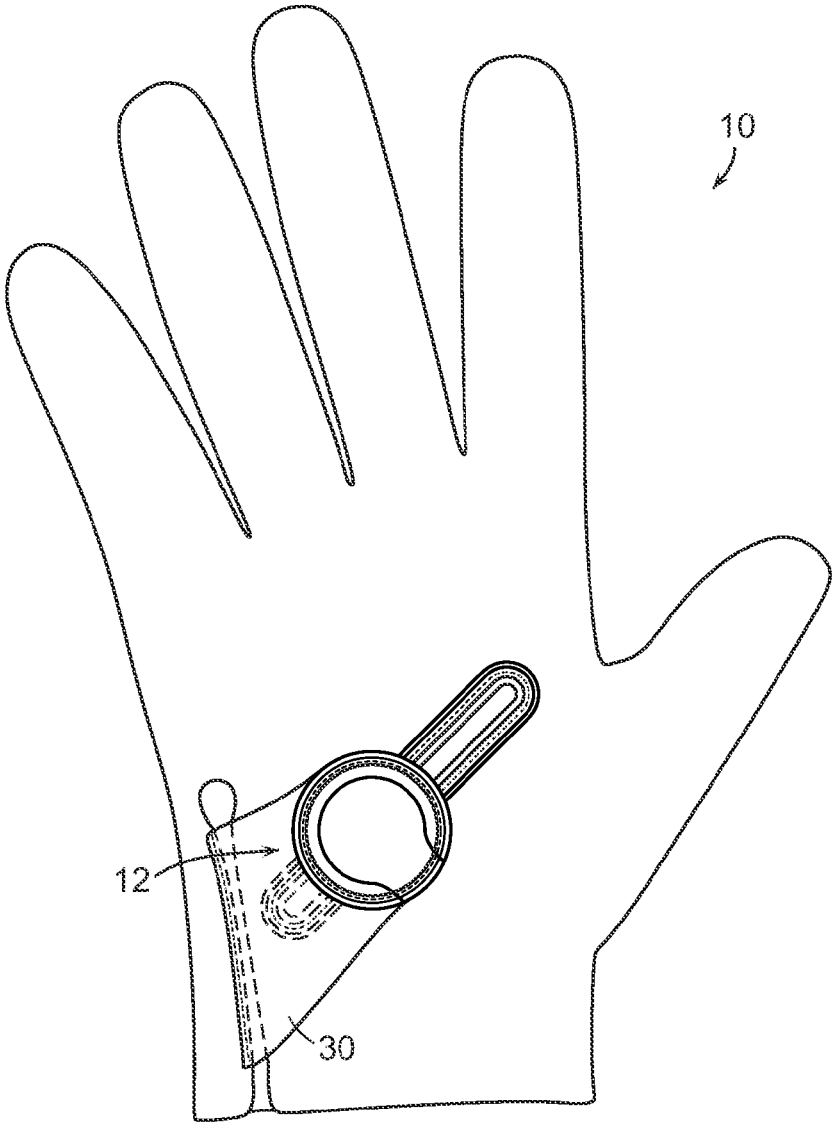
FIG. 1 is a back view of an embodiment of an inventive golf glove closing device incorporating a sliding push button on a slide bar.
Figure 2:
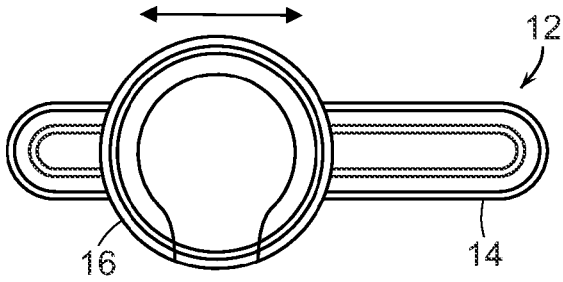
FIG. 2 is a top plan view of the sliding button and slide bar.
Figure 3:
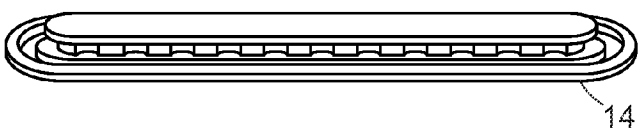
FIG. 3 is a top perspective view of the slide bar and notches.

The present invention is directed to a glove comprising a push-button that engages a slide bar wherein the button upon being moved along the slide bar has means for locking at a plurality of positions on the slide bar, and therein either tightening or loosening the glove. The inventive glove has an adjustable range and an adjustable snug fit, and is very durable.

While the present invention is discussed in connection with sport gloves, e.g., baseball, racquetball or golf gloves, it is understood that the inventive push-button system can be used in any type of glove requiring a tightening or closure system.

FIGS. 1 to 6 illustrate a golf glove 10 of the type worn by golfers to ensure a firm grip on a club. Like conventional sport gloves, glove 10 includes fingers 11 and a thumb 13. Glove 10 includes a novel glove closure system 12 for closing and tightening of the glove which comprises a push-button 16 engaging a sliding bar 14 as discussed below.

In more detail, glove 10 is of flexible construction, preferably comprising leather, or synthetic leather including but not limited to polyurethane leather (e.g., polyurethane coated nylon), or non-woven material, and can be perforated with ventilation holes on the back surface of the fingers. The glove body includes a front surface (not shown), and a dorsal, back surface which is divided by an access opening 32 into a lateral portion 21 adjacent the thumb and a medial portion 23 (near the pinkie). Opening 32 may optionally be filled with an elastic material or fabric.

Figure 4:
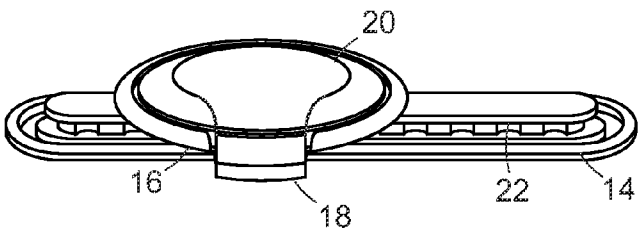
FIG. 4 is a top perspective view of the sliding button an slide bar.
Figure 5:
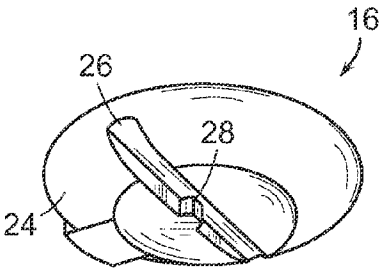
FIG. 5 is a bottom perspective view of the lock mechanism of the tightening flap.
Figure 6:
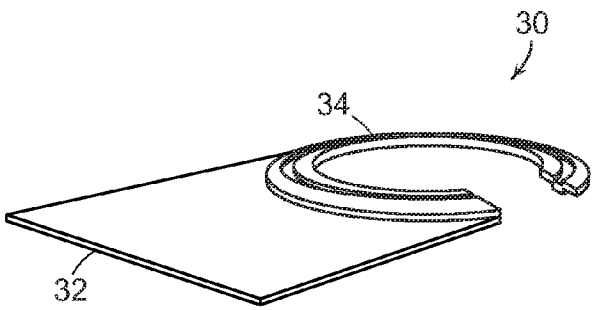
FIG. 6 is a leather base for the closure system.

FIGS. 1-6 illustrate a glove 10 with glove closure system 12 in a relatively closed position. Glove closure system 12 includes a generally rectangular or oval flap 30, preferably made of leather material, wherein a distal end 33 is attached to the back surface in the medial portion by a row of marginal stitching along the access opening 33, and overlaying the opening while extending into the lateral portion 21. The generally rectangular flap 30 includes a partially round aperture 34 wherein the button may be attached to the flap while allowing the bottom of the button to be engaged with the slide bar attaching the push-button 16 thereupon, as best seen in FIGS. 4 and 6.

In the preferred embodiment, a slide bar 14 is attached to the back surface of the lateral portion 21, preferably by sewing. The slide bar 14 is of a relatively narrow longitudinal shape having a perimeter section 15 for stitching onto the glove 10 and a raised section 17 incorporating a plurality of notches 22 for engaging the push-button 16. The push button 16, as best seen on FIG. 5, consists of an engaging strip 26 with a recess 28 located on the lower surface 24 for locking into one of the notches 22 on the slide bar 14. The push button 16 includes a depression tab 20 wherein the button may be pushed downward and therein releasing the button from a locking position with one of the notches and allowing the button to move along the bar 14. Upon movement to a desired spot along the tab, the depression tab 20 may be released therein locking the glove in a particular closed position. The further the button 16 engages the slide bar 14 toward the thumb, the tighter the closure. A simple press on the depression tab 20 and the glove may become loose for removal. An end section 18 of the button is integrally connected to the engaging strip 26 and upon operation of the depression tab 20 will cause the engaging strip 26 to either engage or disengage with the notches 22.

Since the flap is preferably made from leather, it has minimal expansion or contraction, therefore the user is able to fully engage the flap in a taut relationship with the lateral portion of the glove. Most sport gloves depend upon the flap being able to stretch or expand to ensure a snug fit because the user usually must control the fit with one hand. With the present invention the hand locking is done by pressing of the button and moving it along the slide bar. This facilitates the convenience to the wearer, by allowing the glove to be easily put on, tightened, loosened, or removed, as necessary. This is especially convenient because it allows the wearer to quickly customize the fit of the glove throughout play. For example, if, initially, a glove is fitting properly, during play it might loosen because the leather stretches, or the wearer might decide they would like the glove looser or tighter. With a traditional glove, the wearer would be required to go through the tightening process from the beginning with all of the difficulties that can entail. Using the inventive system, the wearer can merely press the button and move it in either direction to tighten or loosen it a notch or two.

It is to be understood that while certain forms of the present invention have been illustrated and described herein, it is not to be limited to the specific forms or arrangement of parts described and shown. An example may be where push button closure system utilizes some other shaped item to press and release the locking mechanism, or alternatively where a closure assembly other than leather is used as a flap. This invention is also not to be limited to the specifically preferred embodiments depicted therein.

I claim:

1. A glove closure system comprising:

a glove having fingers, thumb and a back surface having an access opening defined therein to separate a lateral portion from a medial portion;

a flap attached to the medial portion at an area near the access opening and partially covering the access opening, and an aperture defined in the flap;

a push button mounted within the aperture in the flap;

a longitudinal slide bar attached to the back surface of the glove in the lateral portion, the slide bar having a raised section with a plurality of notches;

an engaging strip on a bottom surface of the button with a recess defined therein for locking into the notches of the slide bar; and the button can be moved along the slide bar by engaging with the plurality of notches to create a degree of glove tightness.

2. The glove closure system of claim 1, wherein the flap is generally rectangular or oval in shape.

3. The glove closure system of claim 1, wherein the flap is made of leather.

4. The glove closure system of claim 1, wherein a distal end of the flap is stitched to the medial portion along the access opening.

5. The glove closure system of claim 1, wherein the slide bar has a perimeter section for stitching to the lateral portion of the glove.

6. The glove closure system of claim 1, wherein the push button is made of an ABS plastic.

7. The glove closure system of claim 1, wherein the slide bar is made of a soft EPA material.

* * * * *